United States Patent [19]

Berich

[11] 4,220,024

[45] Sep. 2, 1980

[54] LOCK MECHANISM

[76] Inventor: John J. Berich, 7518 Forest View Dr., St. Louis, Mo. 63121

[21] Appl. No.: 966,786

[22] Filed: Dec. 6, 1978

[51] Int. Cl.[2] ..... E05B 63/00

[52] U.S. Cl. ..... 70/416; 70/1.7; 70/422

[58] Field of Search ..... 70/416, 422, 1.5, 1.7, 70/333, 418

[56] References Cited

U.S. PATENT DOCUMENTS

| | | | |
|---|---|---|---|
| 3,783,655 | 1/1974 | Giannetto | 70/1.5 |
| 3,881,330 | 5/1975 | Hester | 70/1.5 |
| 3,961,504 | 6/1976 | Sprecher | 70/1.5 |

*Primary Examiner*—Robert L. Wolfe

*Attorney, Agent, or Firm*—Neal Kalishman

[57] ABSTRACT

A lock mechanism that is particularly adapted for use on automobile trunks which comprises a lock cylinder, an actuating member, a latch assembly, and a spring type tension member. When substantial force is applied to the face of the lock cylinder the lock cylinder and actuating member swing away from the force and render the lock mechanism inoperative. Upon withdrawal of the force the lock cylinder and actuating member return to their original position to allow the lock mechanism to function normally. To prevent the lock cylinder from being pulled out the cylinder face is recessed within the wall of the trunk.

An alternative embodiment provides for the entire lock mechanism to pivot away when a force is applied.

19 Claims, 7 Drawing Figures

LOCK MECHANISM

BACKGROUND OF THE INVENTION

I. Field of the Invention

The present invention is directed to a lock mechanism that is capable of resisting unauthorized forced opening. Specifically, the invention is concerned with a lock mechanism for use on automobiles and vending machines that not only resists unauthorized opening but is capable of functioning normally after an attempted opening of the lock has occurred.

II. Description of the Prior Art

Ownership of an automobile has become a necessity for most individuals and families. This has created the need for large parking lots and substantial street parking. Since most automobile have trunks, the automobile has become a common storage place for many items such as tools, clothing, etc. that are being transported from one place to another or that are needed at different locations. In light of the number of automobiles that have goods stored in their trunks, certain elements in society have found it very lucrative to break into automobiles that are on large parking lots or on poorly lit streets and steal their contents.

A common means of breaking into an automobile is to "punch" the lock on the trunk or door of the automobile. Usually a person "punches" a lock by taking a screwdriver or other object and placing it in the key opening of the lock's cylinder lock component. Force is then applied to knock out or otherwise remove the cylinder lock. Either the cam actuating mechanism or the levers of the latch lock are then exposed and can be manipulated to open the lock. This operation can be performed unobtrusively and within a few seconds. It is extremely difficult to apprehend an experienced thief while he is in the process of "punching" an automobile lock. The number of thefts which have occurred by use of punching techniques is considerable. This problem is also prevalent in the vending machine industry.

Several solutions have been proposed to solve this problem. For instance, U.S. Pat. No. 3,881,330 proposes to solve the problem by employing a blocking member which blocks the lock opening following the exposing of the cam activating mechanism or levers of the latch lock. U.S. Pat. No. 3,961,504 proposes a latch assembly in which one of the levers of the latch moves out of position when the cylinder lock has been removed. All of the methods of the prior art suffer from a common deficiency. That deficiency is that once the lock mechanism or an external mechanism counteracts the removal of the cylinder lock by protecting the latch mechanism it is impossible for the lawful owner to enter the trunk. Thus, not only is the criminal blocked from making entry into the vehicle, but also the owner after an attempted entry can only gain access to the trunk by dismantling the trunk through the rear seat fire wall.

The present invention is advantageous in that it provides a locking mechanism which is capable of functioning normally following an unauthorized attempted opening or manipulation of the lock. The mechanism is compatible with almost all currently manufactured automobile locks. The present invention has high reliability and is simple to install. The invention can be manufactured inexpensively and is a deterent to attempted unauthorized entries. The invention can be used with both locks placed on new automobiles and those contained on existing automobiles.

SUMMARY OF THE INVENTION

The present invention provides a lock mechanism comprising a lock cylinder means, an actuation means, a tensioning means, and a latch assembly means. The actuation means communicates between the lock cylinder and the latch assembly. The tensioning means maintains the position of the lock cylinder and the actuation means under normal conditions. When force is applied to the lock cylinder the tensioning means allows the lock cylinder and actuation means to move to positions that prevent with the actuation means communication with the latch assembly. The latch assembly is thus rendered inoperative.

The present invention further provides for a lock mechanism comprising a lock cylinder means, an actuation means, a tensioning means, and a latch assembly. The actuation means communicates between the lock cylinder and latch assembly. The tensioning means maintains the position of the lock mechanism under normal operating conditions. When force is applied to the lock cylinder, the tensioning means permits the lock mechanism to move in the direction away from the force and so renders the lock mechanism inoperative. When the force is withdrawn the lock mechanism returns to its original position and functions in its normal manner.

DESCRIPTION OF THE PREFERRED EMBODIMENTS

Figure 1:
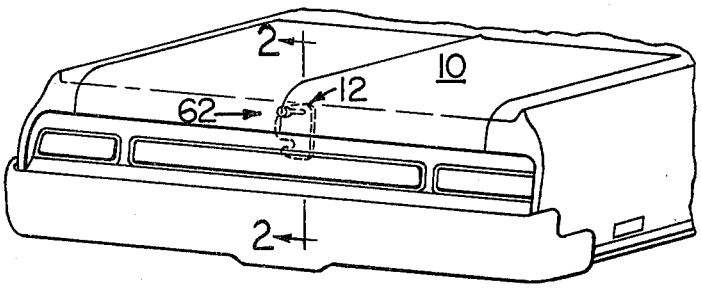
FIG. 1 is a fragmentary perspective view of the rear position of an automobile vehicle body incorporating the lock mechanism of the present invention.
Figure 1:
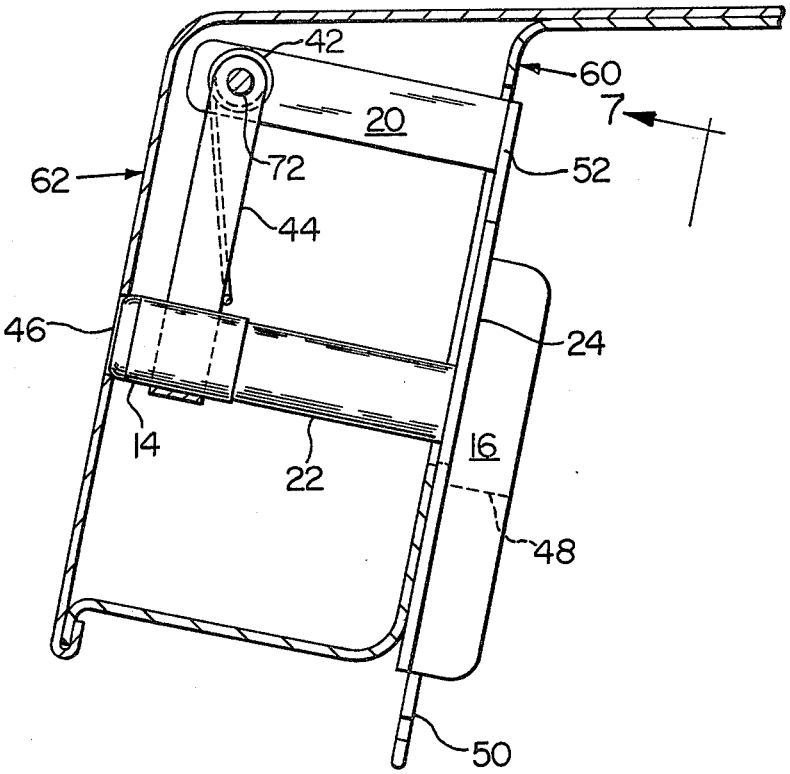

The present invention is directed to a lock mechanism which is rendered inoperative and/or unbreakable during attempted unauthorized opening. The lock mechanism is capable of functioning normally when the unauthorized attempted opening is abandoned. The invention will be described in reference to an automobile trunk, however, it's utility is not limited to automobiles and could be utilized on vending machines, etc. FIG. 1 depicts the rear portion of an automobile vehicle body of conventional structure. This body contains a trunk 10 having a lock 12. The lock serves to maintain the trunk in a closed position and to secure the contents of the trunk.

Figure 2:
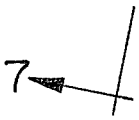
FIG. 2 is an enlarged sectional view taken along the plane indicated by lines 2—2 in FIG. 1.
Figure 7:
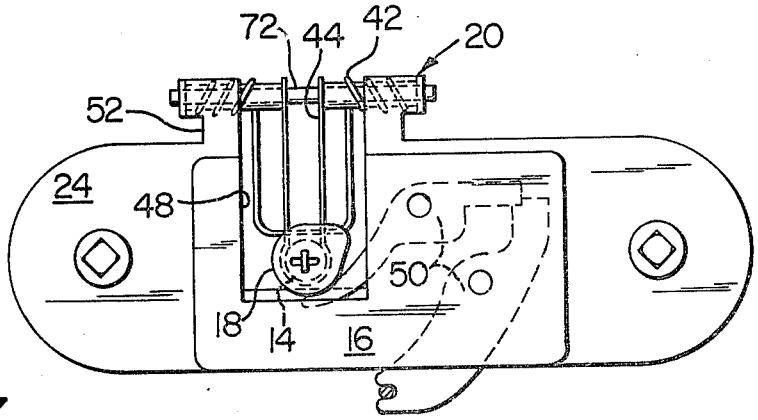
FIG. 7 is a view taken generally along the plane indicated by lines 7—7 in FIG. 2.
Figure 5:
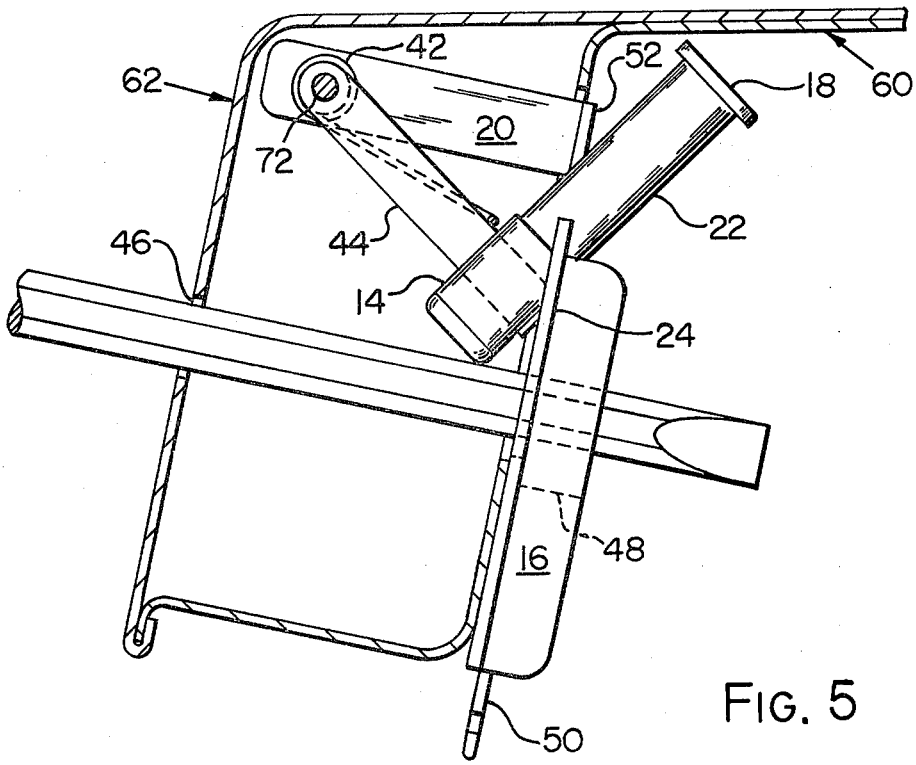
FIG. 5 is a cross sectional view of a lock mechanism showing the movement of a lock mechanism of the present invention when a force is applied to the cylinder lock.

As shown in FIGS. 2, 5 and 7 the lock contains a cylinder lock 14 of standard design. The cylinder lock is actuated by a key which rotates the shaft 22. The shaft rotates the cam or actuation means 18 which actuates or triggers the latch mechanism 16. In a conventional trunk the face of the cylinder lock is fixedly attached to the wall 62 of the trunk.

The latch mechanism 16 which is attached to an inner trunk wall 60 by plate 24 is comprised of a coordinated set of spring tensioned levers 50. The latch mechanism is of well known design and any lever mechanism which is cam actuated would be suitable for use in the present invention. An example of a conventional lock mechanism utilizing a cylinder lock and latch mechanism combination is shown in U.S. Pat. No. 3,881,330 and U.S. Pat. No. 3,961,504, which are incorporated by reference herein.

The present invention modifies conventional lock mechanism so as to render the trunk invulnerable from attack by standard lock "punching" techniques. The lock cylinder 14 with its shaft 22, and cam 18 form a functional unit. This unit instead of being supported by its attachment to the body of the automobile wall is maintained in position by a tensioning device 20. The tensioning device is comprised of a spring 42 and a bracket 44. The bracket is "U" shaped and is attached or integral to the latch assembly 16 and to the cylinder lock 14. The bracket goes through inner wall 60 at point 52. The arm of the bracket that is attached to the lock cylinder 14 is pivotal about point 72. The spring is preferably a torsion spring, although, other types of springs, such as, extension, or compression may be utilized.

As shown in FIG. 5, when a force is applied to the face of the cylinder lock the tensioning mechanism permits the cylinder lock cam unit to move away from the applied force or pivot about lugg 72. Thus, the lock cylinder and the cam remain as a unit during the attempted forcing of the lock cylinder, instead of the lock cylinder severing and falling into the trunk cavity. When the force is removed the lock cylinder - cam unit are returned to their orginal position by the tensioning spring. Usually manual manipulation of the lever mechanism is not possible since the trunk apperature is not large enough to allow entry of a second probe. However, in those situations where manipulation is possible, means could be incorporated into the mechanism to restrict access to the lever mechanism.

In order to assure alignment of the cam with the lever mechanism there are two alternatives. First, the aperature 46 in the vehicle body that accomodates the cylinder lock can be smaller than the face of the cylinder and thereby block the cylinder - cam unit from returning beyond its normal position. Thus, recessing the lock within the wall of the automobile body. Second, the plate 24 of the lever mechanism 16 can have an appurture 48 which is large enough to allow the shaft 22 to pass through but, is smaller than the face of cam 18. It is preferred, that both methods be utilized simultaneously. By recessing the face of the lock cylinder in the body of the automobile it makes it impossible for the lock cylinder to be pulled out from the lock mechanism. By utilizing plate 24 to prevent the cam from excess return movement, alignment is assured even if the wall of the automobile body is damaged.

The preferable size of the tensioning means will depend on the amount of force that is normally applied to a lock cylinder when a key is properly inserted into the cylinder. The tensioning means must be capable or of sufficient size to withstand such a force without allowing the cylinder lock-cam unit to move. If movement does occur then opening of the trunk is impossible. The tensioning means must however be small enough to permit movement of the lock cylinder - cam unit at the point where the force applied separates the lock cylinder 14 from the shaft 22, which are connected through a wire arrangement. Determining the specific spring size is therefore dependent upon the materials and type of tensioning means utilized. Preferably the spring should not allow movement when less than one pound is applied to the face of the cylinder lock.

Figure 3:
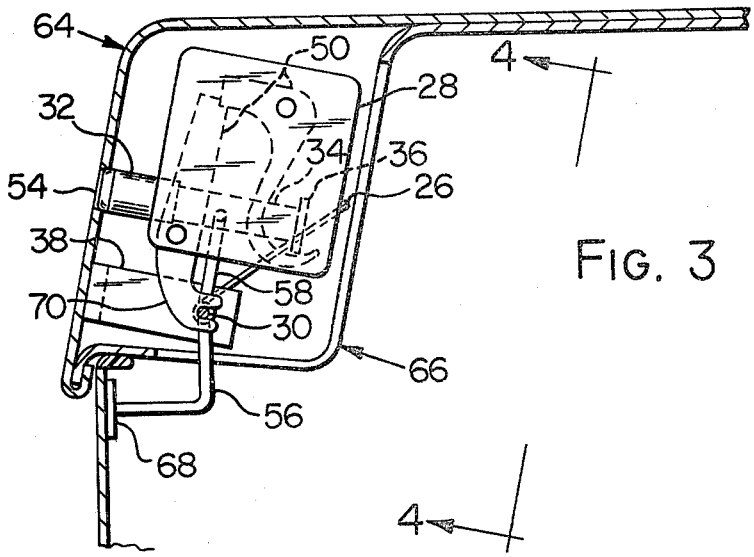
FIG. 3 is an enlarged sectional view taken generally along the plane indicated by lines 2—2 in FIG. 1 of an alternative embodiment of the invention.
Figure 4:
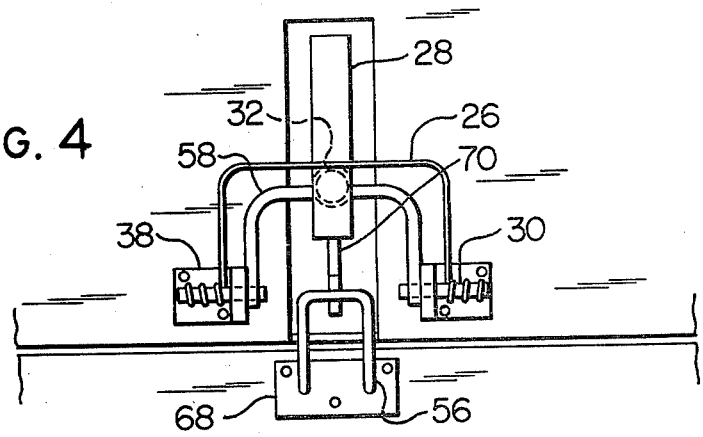
FIG. 4 is a view taken generally along the plane indicated by lines 4—4 in FIG. 3.
Figure 6:
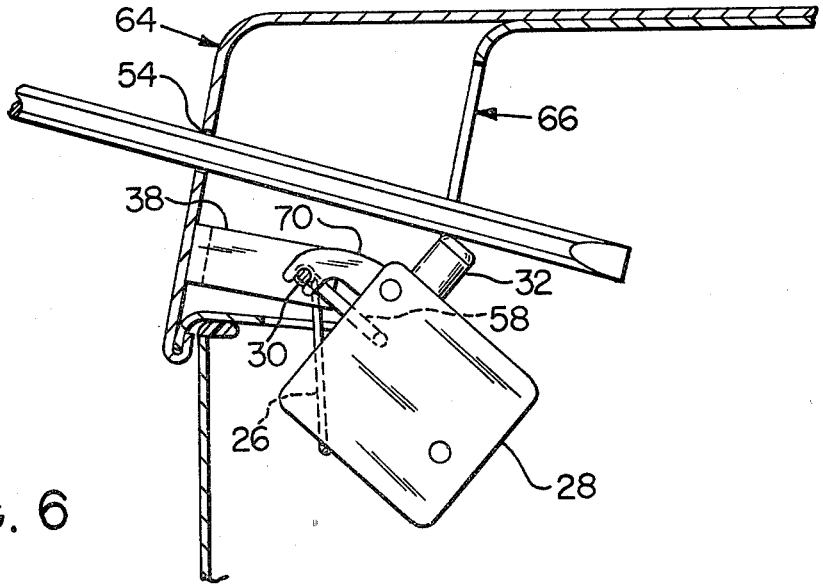
FIG. 6 is a cross sectional view of a lock mechanism of the alternative embodiment of the present invention showing the lock mechanism's movement when force is applied to the lock cylinder.

An alternative embodiment of the invention is to mount the latch mechanism sideways in order to permit the entire lock mechanism to rotate when unauthorized force is applied to it. This embodiment is shown in FIGS. 3, 4 and 6. The spring 26 is attached to the latch mechanism body 28 in order to permit the pivoting of the locking mechanism and bar 58 about point 30. The cylinder lock 32 with its shaft 34 forms a unit with the actuating means 36. The cam actuating means is preferably a right angle cam. This unit is attached to the lever lock means which allows the lever lock means to pivot when excessive or a predetermined force is applied to the face of the lock cylinder. The inner trunk wall 66 is cut out to allow such pivoting. When such a force is withdrawn the lock mechanism returns to its original position and functions in its normal manner.

To prevent the lock mechanism from returning past its normal position the key hole aperture 54 of the automobile body wall 64 should be smaller than the face of the lock cylinder. That is the lock cylinder should be recessed within the automobile body wall. During an unauthorized attempted operating of the lock mechanism lateral movement of the mechanism is prevented by the use of pivot bracket 38 on either side of the lock mechanism. The lock mechanism while pivoting maintains its grasp by hook 70 on a rodlike striker member 56 which is fixedly attached through brackets 68 to the lower portion of the inside vehicle body. The striker cooperates with the latch mechanism in keeping the trunk in a closed position. The tension mechanism or torsion spring 26 which is attached to the inside wall of the vehicle and to the side walls of the latch assembly must have sufficient strength to maintain the position of the lock mechanism during normal key insertion into the lock cylinder. As described above, the tension means is selected so as to allow movement of the lock mechanism at the point just prior to where the applied force is sufficient to separate lock cylinder 32 from shaft 34 or approximately one pound of force. The lock mechanism is maintained in position through the cooperation of stabilizing bar 58 which is rotatably attached to bracket 38 and spring 26.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all charges which come within the meaning and range of equivalency of the claims are therefore intended to be embraced therein.

I claim:

1. A lock mechanism comprising a lock cylinder means, a latch assembly means and a means for actuating said latch assembly upon communication by said lock cylinder means, wherein said lock mechanism contains a tension means for maintaining the position of said lock cylinder means and actuating means and which renders the lock mechanism inoperative by moving the actuating means away from the latch assembly during the application of unauthorized force to the lock cylinder.

2. The lock mechanism of claim 1 wherein said actuating means comprises a cam.

3. The lock mechanism of claim 1 wherein said lock cylinder means comprises a key tumbler lock.

4. The lock mechanism of claim 1 wherein said tension means comprises a spring.

5. The lock mechanism of claim 4 wherein said spring is selected from the group consisting of torsion, extension, or compression springs.

6. The lock mechanism of claim 1 wherein said mechanism is utilized as an automobile trunk lock.

7. The lock mechanism of claim 6 wherein the face of the lock cylinder means is smaller than the key aperature of the trunk.

8. The lock mechanism of claim 1 wherein said mechanism is utilized as a vending machine lock.

9. The lock mechanism of claim 3 wherein the tension means renders the mechanism inoperative when the force applied to the lock cylinder means is at least greater than the force applied during an authorized key insertion.

10. The lock mechanism of claim 1 wherein the tension means renders the lock mechanism inoperative when the force applied to the lock cylinder means is at least one pound.

11. The lock mechanism of claim 1 wherein said tension means is attached to or forms a part of said latch assembly.

12. A lock mechanism comprising a lock cylinder means, a latch assembly means and a means for actuating said latch assembly upon communication by said lock cylinder means, wherein said lock mechanism contains a tension means for maintaining the position of said lock mechanism and when an unauthorized force is applied to the lock cylinder the tension means renders the lock mechanism inoperative by pivoting the mechanism away from the point of impact of the unauthorized force.

13. The lock mechanism of claim 12 wherein said tension means comprises a spring.

14. The lock mechanism of claim 13 wherein said spring is selected from the group consisting of torsion, extension, or compression springs.

15. The lock mechanism of claim 12 wherein said mechanism is utilized as an automobile trunk lock.

16. The lock mechanism of claim 15 wherein the face of the lock cylinder means is smaller than the key aperature of the trunk.

17. The lock mechanism of claim 15 wherein the tension means renders the mechanism inoperative when the force applied to the lock cylinder means is at least greater than the force applied during an authorized key insertion.

18. The lock mechanism of claim 12 wherein the tension means renders the mechanism when the force applied to the lock cylinder means is at least one pound.

19. The lock mechanism of claim 11 wherein said mechanism is utilized as a vending machine lock.

* * * * *